US007180078B2

(12) United States Patent
Pau et al.

(10) Patent No.: US 7,180,078 B2
(45) Date of Patent: Feb. 20, 2007

(54) INTEGRATED PLANAR ION TRAPS

(75) Inventors: Stanley Pau, Hoboken, NJ (US); Richart Elliott Slusher, Lebanon, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 11/048,229

(22) Filed: Feb. 1, 2005

(65) Prior Publication Data

US 2006/0169882 A1 Aug. 3, 2006

(51) Int. Cl.
*G21K 1/08* (2006.01)

(52) U.S. Cl. ..... 250/396 R; 250/378; 250/489

(58) Field of Classification Search ..... None
See application file for complete search history.

(56) References Cited

U.S. PATENT DOCUMENTS

| | | | | |
|---|---|---|---|---|
| 5,206,506 | A * | 4/1993 | Kirchner | 250/281 |
| 5,501,893 | A | 3/1996 | Laermer et al. | 428/161 |
| 6,075,263 | A * | 6/2000 | Takahashi et al. | 257/284 |
| 2005/0040327 | A1 * | 2/2005 | Lee et al. | 250/288 |

OTHER PUBLICATIONS

U.S. Appl. No. 11/003,823, filed Dec. 3, 2004, Aksyuk et al.
U.S. Appl. No. 10/656,432, filed Sep. 5, 2003, Pai et al.
U.S. Appl. No. 10/780,091, filed Feb. 27, 2004, Pai et al.
Miller, K., et al., "Die-scale wafer flatness: 3-dimensional imaging across 20 mm with nanometer-scale resolution," SPIE Microlithography, 4689-92, (2002), 5 pages.
McAuley, S.A., et al., "Silicon micromachining using a high-density plasma source," Journal of Physics D: Applied Physics, vol. 34, pp. 2769-2774, (2001).
Rosen, D., et al., "Membrane covered electrically isolated through-wafer via holes," Journal of Micromechanics and Microengineering, vol. 11, pp. 344-347, (2001).
Yamada, H., et al., "High-Density 3-D Packaging Technology Based on the Sidewall Interconnection Method and Its Application for CCD Micro-Camera Visual Inspection System," IEEE Transactions on Advanced Packaging, vol. 26, No. 2, pp. 113-121, (2003).
Wu, J.H., et al., "A Through-Wafer Interconnect in Silicon for RFICs," IEEE Transactions on Electron Devices, vol. 51, No. 11, pp. 1765-1771, (Nov. 2004).
Kielpinski, D., et al., "Architecture for a large-scale ion-trap quantum computer," Nature, vol. 417, pp. 709-711, Jun. 13, 2002.
Zhang, Y., et al., "Importance of wafer flatness for CMP and lithography," SPIE, vol. 3050, pp. 266-269, (1997).

* cited by examiner

*Primary Examiner*—Nikita Wells
*Assistant Examiner*—Anthony Quash
(74) *Attorney, Agent, or Firm*—John F. McCabe

(57) ABSTRACT

An apparatus for an ion trap includes an electrically conductive substrate having top and bottom surfaces and having vias that cross from the top surface to the bottom surface. The apparatus includes a pair of planar first electrodes supported over said top surface and second electrodes having planar surfaces. The planar surfaces are located over said top surface, and portions of the planar surfaces are located laterally adjacent to said planar first electrodes. One of the second electrodes includes a portion that is located in one of the vias and traverses the substrate.

19 Claims, 12 Drawing Sheets

INTEGRATED PLANAR ION TRAPS

BACKGROUND

1. Field of the Invention

The invention relates to ion traps and systems and methods that use ion traps.

2. Discussion of the Related Art

FIG. 1A illustrates a conventional design for a planar ion trap 8. The ion trap 8 includes central electrode 10, inner surrounding electrodes 12, and outer surrounding electrodes 14. The electrodes 10, 12, 14 have rectangular shapes, and the outer electrodes 14 are segmented. The electrodes 10, 12, 14 are flat metal layers that are located on a planar top surface of a quartz or alumina substrate 16. Thus, the electrodes 10, 12, 14 of the ion trap 8 have a planar structure.

Operating the planar ion trap 8 involves applying a high frequency voltage between the inner surrounding electrodes 12 and the central and outer surrounding electrodes 10, 14, and applying a static or quasi-static voltage between the segments of outer surrounding electrodes 14. The high-frequency voltage produces a pattern of electric fields, E, with a small quadruple component in a cylindrical free-space region 18 that is located above and between the paired inner surrounding electrodes 12 as illustrated is FIG. 1B. In the free-space region 18, the high-frequency electric fields can traps ions vertically and laterally. The static or quasi-static voltage produces an electric field pattern that can trap the ions along the axis of the ion trap 8. Thus, the combination of high frequency and static or quasi-static voltages traps ions in the planar ion trap 8.

The ion trap 8 also includes a number of metallic electrical leads (not shown) that run along the top surface of the substrate 16. The electrical leads connect the electrodes 10, 12, 14 to high-frequency and static or quasi-static voltage drivers (not shown). These drivers are located off the edges of the substrate 16.

BRIEF SUMMARY

Various embodiments provide structures for planar ion traps and arrays of ion traps in which electrical connections are conveniently disposed. The structures include special electrical connections that traverse the substrates on which the ion traps are located rather than running out to lateral edges of the substrates. In particular, the special electrical connections are located in vias that traverse the thickness of the substrates. Thus, control voltage sources can connect to the ion traps through surfaces of the substrates that are opposite to the surfaces on which the ion traps themselves are located. Such backside connection configurations enable shielding control circuitry from high intensity radio frequency (RF) fields of the ion traps and also provide simple connection layouts for control voltage sources. Due to the simple connection layouts, arrays of the ion traps can have patterns that would be unavailable in the absence of such backside connections. These special via-based connections also permit designs for high-density arrays of ion trap electrodes in which electrical crosstalk is low.

In one aspect, the invention features an apparatus for an ion trap. The apparatus includes an electrically conductive substrate having top and bottom surfaces and one or more vias that cross from the top surface to the bottom surface. The apparatus includes a pair of planar first electrodes supported over the top surface and second electrodes. The second electrodes have planar surfaces that are also located over the top surface. Portions of the planar surfaces are located laterally adjacent to the planar first electrodes. One of the second electrodes includes a portion that is located in one of the vias and traverses the substrate.

In another aspect, the invention features an apparatus. The apparatus includes an electrically conductive substrate having top and bottom surfaces and having a plurality of ion traps. Each ion trap has first and second electrodes and is configured to trap ions over the top surface of the substrate. Each second electrode includes a portion that crosses through the substrate.

BRIEF DESCRIPTION OF THE DRAWINGS

Herein, like reference numbers indicate functionally similar structures and/or features.

Herein, some figures may exaggerate dimensions of certain elements to better illustrate the embodiments.

DETAILED DESCRIPTION OF ILLUSTRATIVE EMBODIMENTS

While illustrative embodiments are described by the Figures and detailed description, the inventions may be embodied in various forms and are not limited to embodiments described in the Figures and detailed description.

Figure 1A:
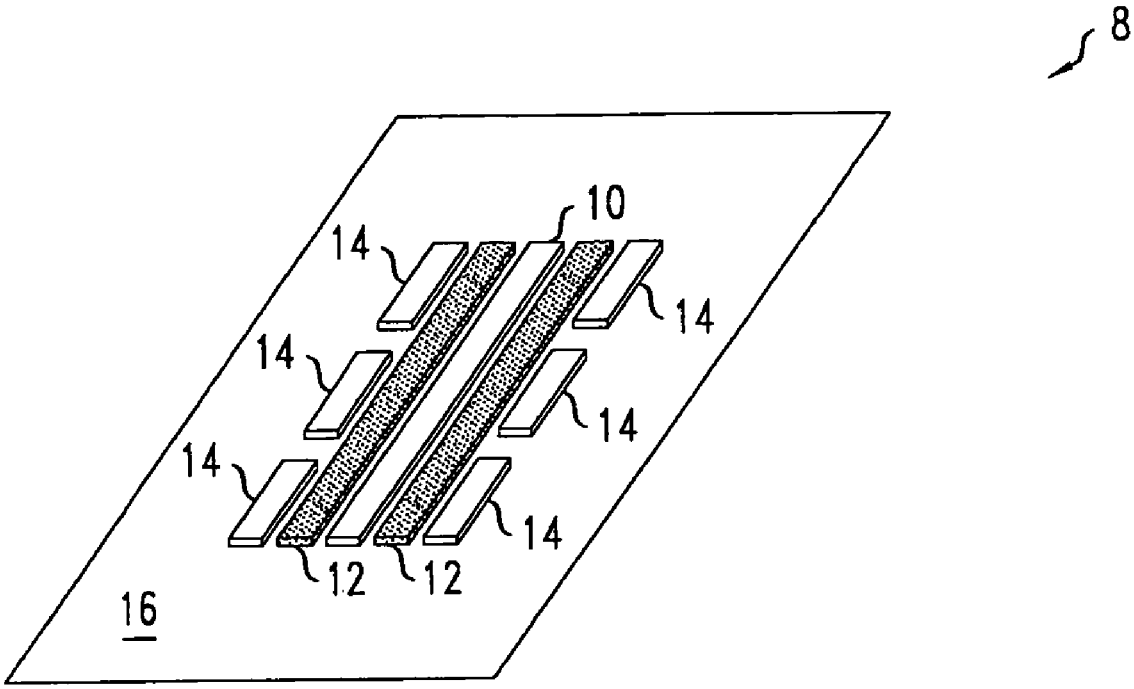
FIG. 1A is an oblique top-view of a conventional planar ion trap.
Figure 1B:
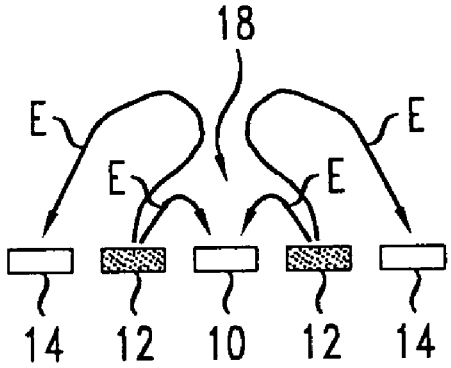
FIG. 1B is a cross-sectional end-view that qualitatively illustrates expected instantaneous electric field lines in the planar ion trap of FIG. 1A.
Figure 2A:
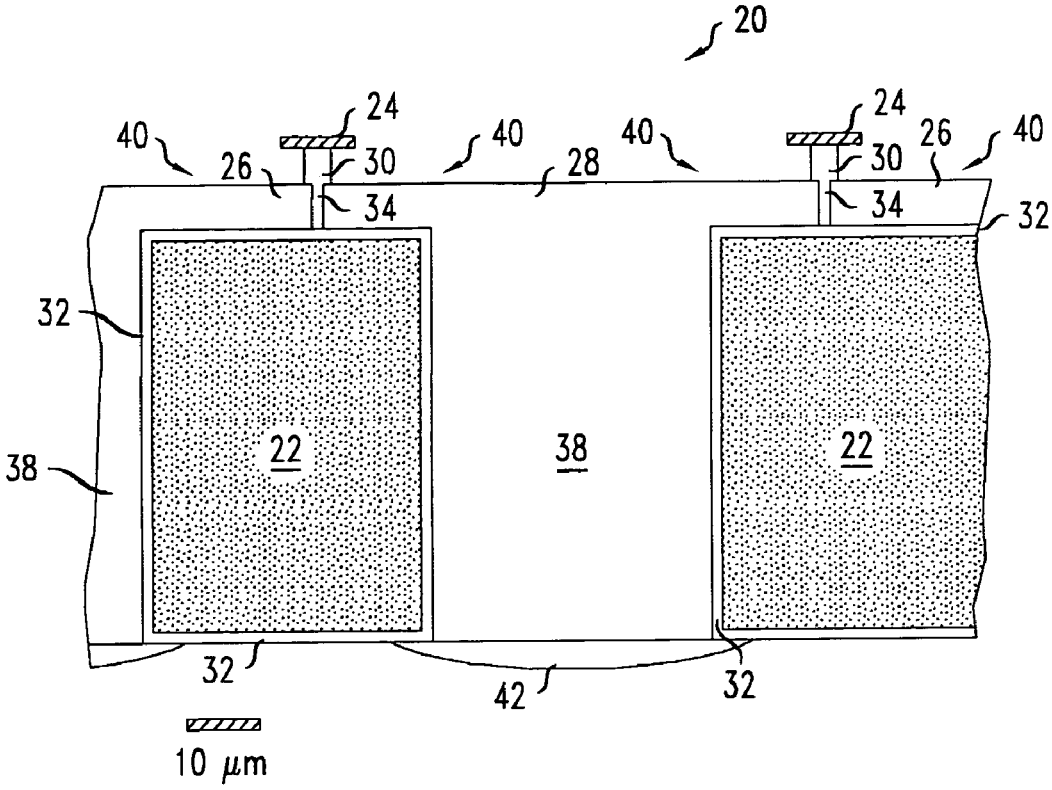
FIG. 2*a* is a cross-sectional end view of a portion of one embodiment of a planar ion trap that is formed on a conductive substrate.
Figure 3:
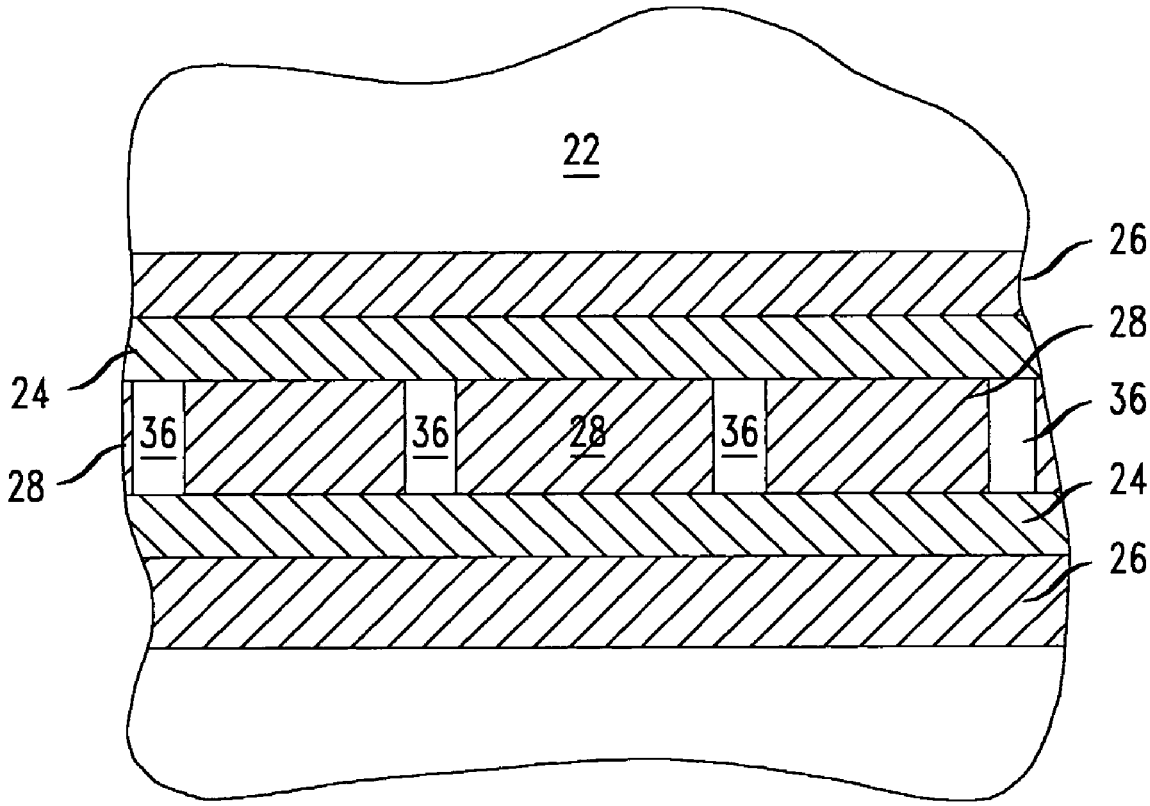
FIG. 3 is a top view of a portion of the ion traps shown in FIGS. 2*a*–2*b;*

FIGS. 2*a* and 3 show an embodiment of a planar ion trap 20 that is configured to be driven by a radio frequency (RF) driver with a frequency of about 100 MHz and a maximum voltage of about 100 volts. Other embodiments of planar ion traps may operate at other high frequencies and voltages.

Herein, RF's are in the range of 10 mega Hertz (MHz) to 300 MHz and preferably are between about 50 MHz to about 200 MHz.

The planar ion trap 20 is integrated into a conducting substrate 22. The substrate 22 is either a metal substrate or a heavily doped semiconductor wafer. An exemplary doped semiconductor substrate is a silicon wafer that has been doped to have a resistivity of about $5\times10^{-3}$ to $5\times10^{-2}$ Ohm-centimeters (Ω-cm). Such silicon wafers may be up to about 8 inches in diameter and have a thickness of 725 micrometers (μm) or less.

The planar ion trap 20 also includes a pair of raised RF electrodes 24, an outer pair of slowly varying of static voltage (SVSV) electrodes 26, and a central SVSV electrode 28. Herein, slowly varying or static voltages vary over times of about $10^{-6}$ second to about 1 second, and SVSV electrodes are configured to apply such SVSV voltages. The RF electrodes 24 are metal films of about 1 μm thick or less, e.g., films of gold, chrome, titanium, or a combination thereof. The outer and central SVSV electrodes 26, 28 are polysilicon, which has been doped to have a low resistivity, e.g., about $10^{-3}$ Ω-cm, thereby reducing RF losses therein. The SVSV electrodes 26, 28 have planar portions 40 that are located over the top surface of the conductive substrate 22 and through-substrate portions 38 that fill vias crossing the conductive substrate 22. To reduce RF losses, the planar portions 40 should have a thickness of about 20 μm or more, and the through-substrate portions 38 should have a diameter of about 50 μm or more. The SVSV electrodes 26, 28 are insulated from the conductive substrate 22 by a thin dielectric layer 32, e.g., a 0.2 μm thick or thinner layer of silicon dioxide, e.g., 0.1 μm of silicon dioxide.

The ion trap 20 occupies a rectangular area over the free top surface of the semiconductor substrate 22. The RF, outer SVSV, and central SVSV electrodes 24, 26, 28 are also rectangular. The central SVSV electrode 28 is separated by silicon dioxide spacers 36 into axial segments, e.g., 50–200 μm long segments, which enable controlling the axial position of ions in the ion trap 20. The various electrodes 24, 26, 28 have lengths of up to about 30 centimeters along the axis of the ion trap 20

In the ion trap 20, the RF, outer SVSV, and central SVSV electrodes 24, 26, 28 have flat top surfaces that are located over and parallel to the top surface of the conductive substrate 22. Dielectric pedestals 30 support the RF electrodes 24 above the SVSV electrodes 26, 28. Exemplary dielectric pedestals 30 are formed of silicon dioxide and have heights of about 5–20 μm, e.g., a height of about 10 μm.

Near the ion trap 20, the two SVSV electrodes 26, 28 preferably are designed to cover substantially all of dielectric layer 32, because uncovered dielectric can produce stray electric fields that affect the ions. For that reason, vias 34, which separate the outer and central SVSV electrodes 26, 28 and vias 36, which, separate segments of the central SVSV electrode 28, are preferably thin. Exemplary vias 34, 36 are covered with silicon dioxide and have small widths of about 0.3 μm or less to limit the amount of uncovered dielectric.

In the ion trap 20, the center-to-center distance between a pair of RF electrodes 24 determines the trapping height and is typically fixed by the form of the optical beams that will be used to address the ions. For example, the trapping height may be selected so that a laser beam can address ions in parallel. Light propagating parallel to the top surface of the conductive substrate 22 can address many ions in parallel if the light does not undergo substantial scattering from topographic features on the top surface. For a Gaussian laser beam with a diameter of about 10–40 μm, such features will not cause significant scattering if the trapping height is about 50 μm above the RF electrodes 24. To produce such a trapping height, the RF electrodes 24 typically would have a center-to-center separation of 50 μm or more, e.g., about 100 μm or more.

During operation, the ion trap 20 laterally and vertically traps ions with a RF electric field and longitudinally traps and moves the ions with a SVSV electric field whose frequency is much lower than that of the RF electric field. A RF voltage driver (not shown) produces the RF electric fields by driving the RF electrodes 24. The RF voltage driver connects between the RF electrodes 24 and the conductive substrate 22. SVSV voltage drivers (not shown) produce the SVSV electric field by driving adjacent segments of the SVSV electrode 28 differently. The SVSV voltage drivers connect to the segments of the SVSV electrode 28 at the bottom of the conductive substrate via the through-substrate portions 38 of the SVSV electrodes 26, 28.

Figure 4:
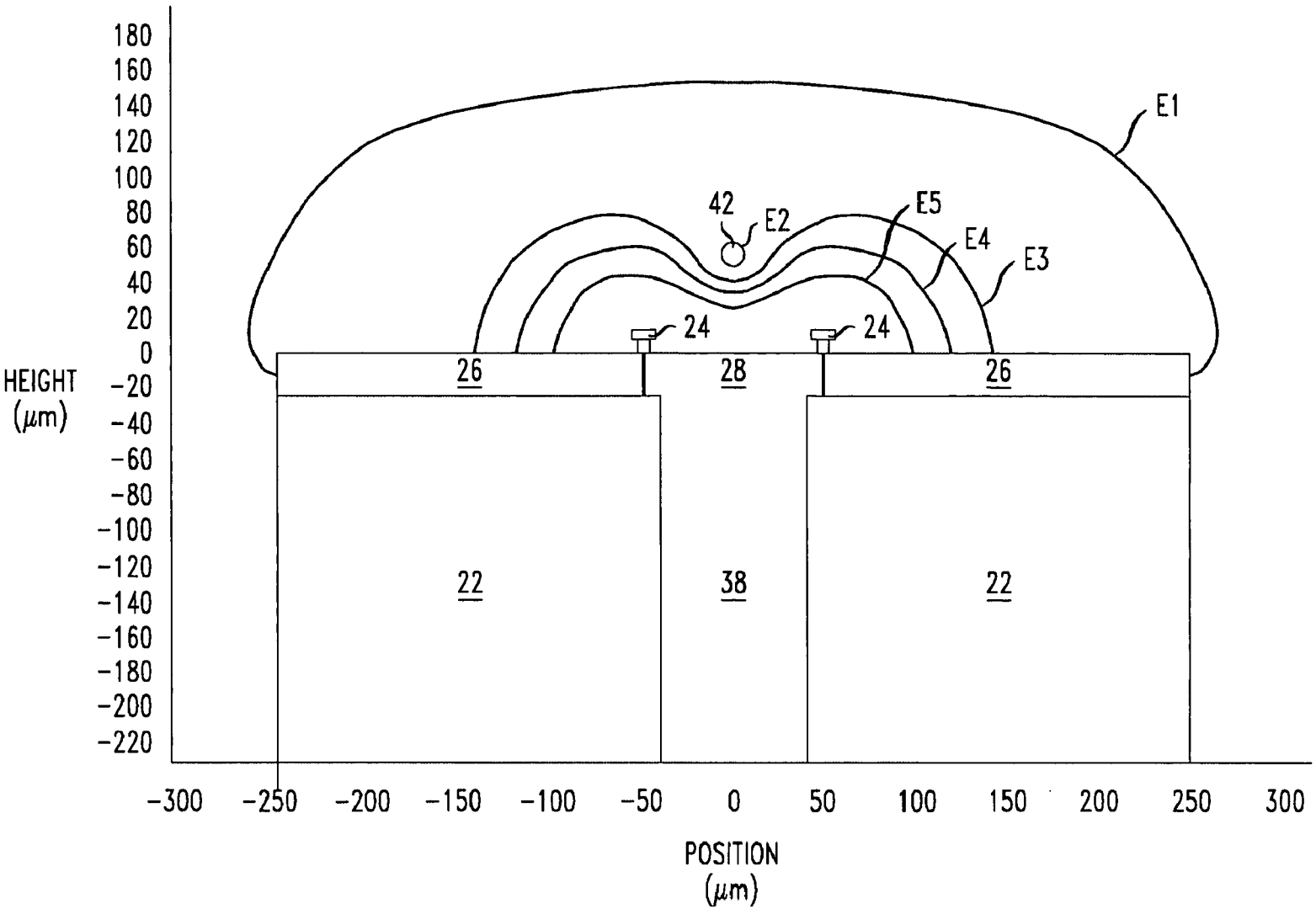
FIG. 4 shows a cross-sectional end-view of an expected pattern of electric field intensities in the ion traps of FIGS. 2*a*, 2*b*, and 3.

FIG. 4 shows an expected pattern of electric field magnitudes, E1–E5, produced when an RF voltage is applied between the RF electrodes 24 and the conductive substrate 22. The pattern includes a cylindrical-shaped region 42 where the magnitude of the electric field typically has a local minimum. The cylindrical-shaped region 42 is located above and between the paired RF electrodes 24. Due to the local minimum of the magnitude of the electric field, the region 42 is able to vertically and laterally trap ions when a strong RF voltage drives the RF electrodes 24.

Figure 2B:
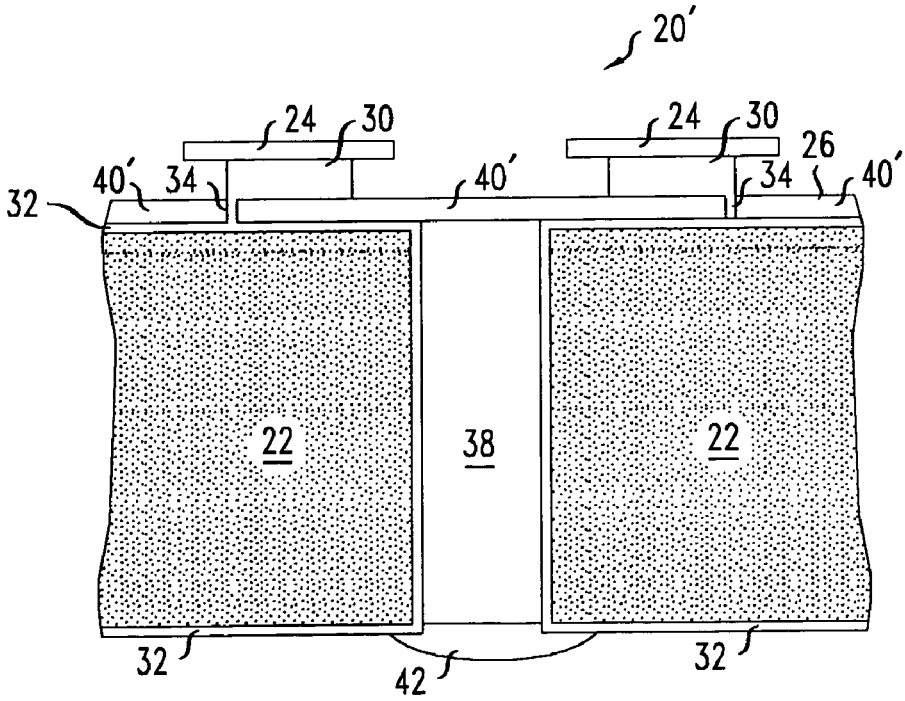
FIG. 2*b* is a cross-sectional end view of a portion of another embodiment of a planar ion trap that is formed on a conductive substrate.

FIG. 2*b* shows an alternate embodiment for an ion trap 20', which is based on silicon-on-insulator (SOI) technology. In the ion trap 20', the planar portions 40 of the SVSV electrodes 26, 28 of FIG. 2*a* are replaced by doped crystalline silicon portions 40'. The SVSV electrodes 26, 28 still include through-substrate portions 38 fabricated with heavily doped polysilicon.

Figure 5:
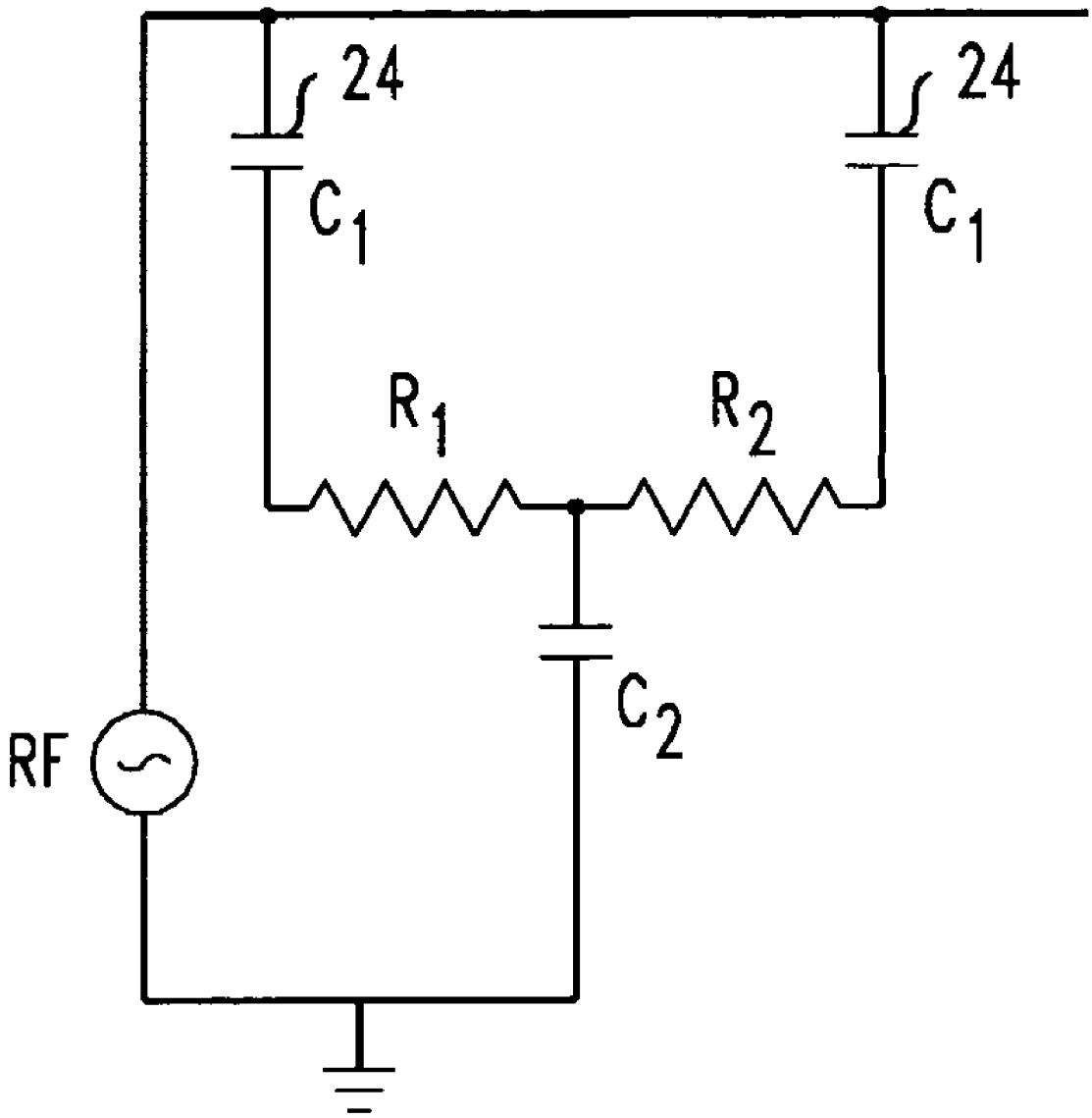
FIG. 5 shows a lumped electrical circuit that illustrates high-frequency shielding and shunt properties of the ion traps of FIGS. 2*a* and 2*b;*

FIG. 5 shows a lumped circuit that simulates the RF behavior of the ion traps 20 and 20' of FIGS. 2*a* and 2*b*, respectively. At RF frequencies, the ion traps 20, 20' function as capacitive bridge divider circuits that include capacitors $C_1$ and $C_2$ and resistors $R_1$ and $R_2$. In the lumped circuit, each $C_1$ capacitor has an upper plate that is formed by one of the RF electrodes 24 and a lower plate that is formed by the planar portions, i.e., element 40 or 40', of the SVSV electrodes 26, 28. In the lumped circuit, each capacitor $C_2$ has an upper plate that is formed by the SVSV electrodes 26, 28 and a lower plate that is formed by the doped semiconductor substrate 22. In the lumped circuit, the resistors $R_1$ and $R_2$ represent the resistances of the paths between exposed surfaces of the SVSV electrodes 26, 28 and surfaces of said electrodes 26, 28 that face the conductive substrate 22. The values of resistors $R_1$ and $R_2$ are substantially determined by the properties of planar portions 40, 40' of the SVSV electrodes 26, 28. In the lumped circuit, the current's return path is between the lower plate of capacitor $C_2$ and the upper plate of capacitor $C_1$ and thus, passes through the conductive substrate 22.

The ion trap 20 has two geometrical features that cause the capacitance of capacitor $C_2$ to be much greater than that of capacitor $C_1$. First, while the plate separation for the capacitor $C_1$ is of the order of the height of dielectric spacers 30, the plate separation for the capacitor $C_2$ is of order of the much smaller thickness of the dielectric layer 32. Second, while the plate area of the capacitor $C_1$ is of order of the area of the RF electrodes 24, the plate area of the capacitor $C_2$ is of order of the much larger area of the portion of the dielectric layer 32 disposed between the conductive substrate 22 and the SVSV electrodes 26, 28. Due to these geometric features, the ratio $C_2/C_1$ can be in the range of about 300 to 3,000 and may often be, at least, as large as about 1,000.

The large value of $C_2/C_1$ ensures that RF voltage driver produces a much larger voltage drop across capacitor $C_1$ than across capacitor $C_2$. That is, even though the RF voltage difference between the RF electrode 24 and the SVSV electrodes 26, 28 may be about 100 volts, RF voltage differences between the SVSV electrodes 26, 28 and the doped semiconductor substrate 22 are much smaller. The large value of $C_2/C_1$ causes the bottom side of the semiconductor substrate 22 to be shielded from the strong RF electric fields that exist in the ion trap 20. The RF shielding or shunting enables the placement of sensitive electrode control circuitry near the bottom surface of the semiconductor substrate 22 and/or electrical connection to the SVSV electrodes 26, 28 from the bottom of the conductive substrate 22.

Embodiments of the ion trap 20, 20' of FIGS. 2*a* and 2*b* may be incorporated into complex spatially multiplexed arrays of the ion traps 10, 10'. Such arrays may find useful applications in a device, which is known as a quantum computer.

Figure 6:
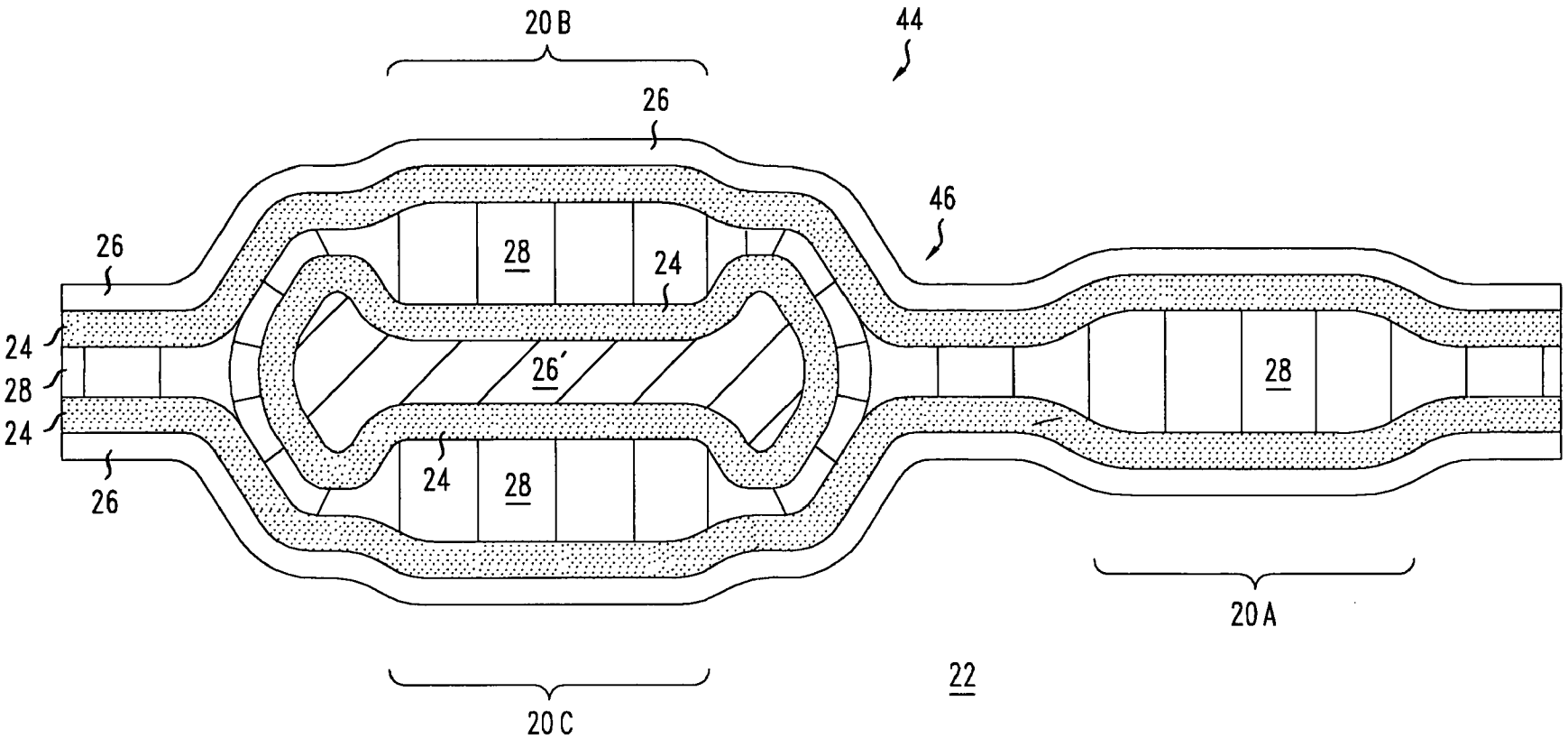
FIG. 6 is a top view of an exemplary integrated structure that includes a connected array of ion traps of either of the types shown in FIGS. 2*a* and 2*b;*

FIG. 6 shows an exemplary array 44 of spatially multiplexed ion traps 20A, 20B, 20C that are located on a single conductive substrate 22. The ion trap 20A connects via ion coupler 46 to both the ion trap 20B and the ion trap 20C. Varying voltages applied to different segments of the SVSV electrode 28 would displace ions from the ion trap 20A to the ion traps 20B, 20C and/or vice versa. The array 44 also, supports complex electrode configurations. For example, SVSV electrode 26' can be on an island over the substrate 22, because electrical connections to the SVSV electrodes 26' pass through the substrate 22 rather than running on the top surface of the substrate 22.

The exemplary array 44 also illustrates that center-to-center distances between RF electrodes 24 may vary in a complex pattern of spatially multiplexed ion traps 20. For example, the RF electrodes 24 are closer together in ion coupler 46 to ensure that the ions are not liberated therein. Similarly, the RF electrodes 24 are farther apart in ion traps 20A, 20B, 20C so that the trapping height is higher above the conductive substrate 22. Then, trapped ion will less affected by stray fields produced by surface charge distributions and will be more accessible to laser beams directed parallel to the top surface of the substrate 22.

In other embodiments, the distance between pairs of RF electrodes varies from ion trap 20 to ion trap 20 so that the ion traps of an array trap ions at different trapping heights.

The backside connections for the SVSV electrodes 26, 28 enable the design of denser and more complex patterns of ion traps 20 over the conducting substrate 22. In particular, the backside connections enable high densities of said ion traps 20.

Figure 7:
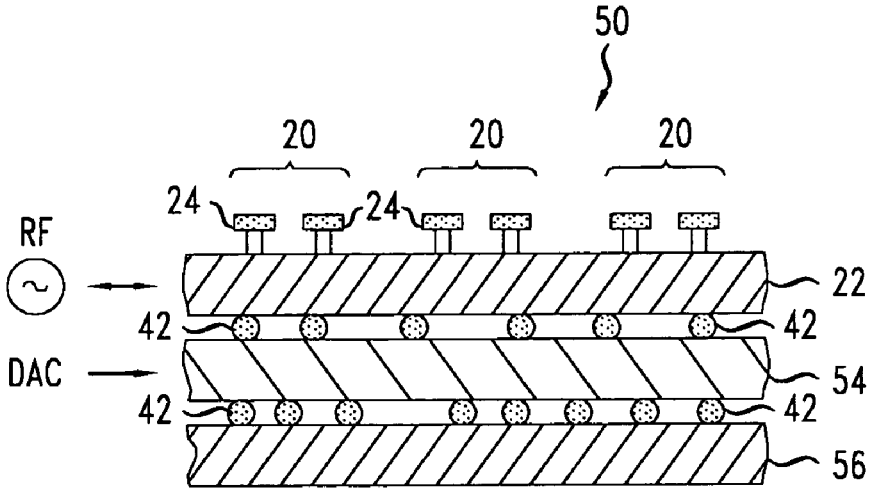
FIG. 7 is a cross-sectional view of a multi-chip module that incorporates the ion traps of FIG. 2*a* or FIG. 2*b;*

FIG. 7 shows a multi-chip module 50 that has an array of ion traps 20 thereon. The multi-chip ion trap module 50 includes a stack that is formed by first, second, and third semiconductor wafers 52, 54, 56 and solder balls 42 that electrically connect adjacent wafers 52, 54, 56. In particular, the multi-chip module 50 couples SVSV voltage drivers and control circuitry to the ion traps 20 via the bottom surface of the doped first semiconductor substrate 52 in which the ion traps 20 are fabricated.

The first semiconductor wafer 52 has a top surface that supports an array of planar ion traps 20 and a bottom surface that is adjacent the second semiconductor substrate 54. The ion traps 20 are driven by an RF voltage driver that connects between the traps' RF electrodes 24 and the doped first semiconductor wafer 52. The second semiconductor wafer 54 is substantially shielded from the intense RF voltages used to operate the ion traps 20 by capacitive bridge circuits in the doped first semiconductor wafer 52 as already described.

Figure 8:
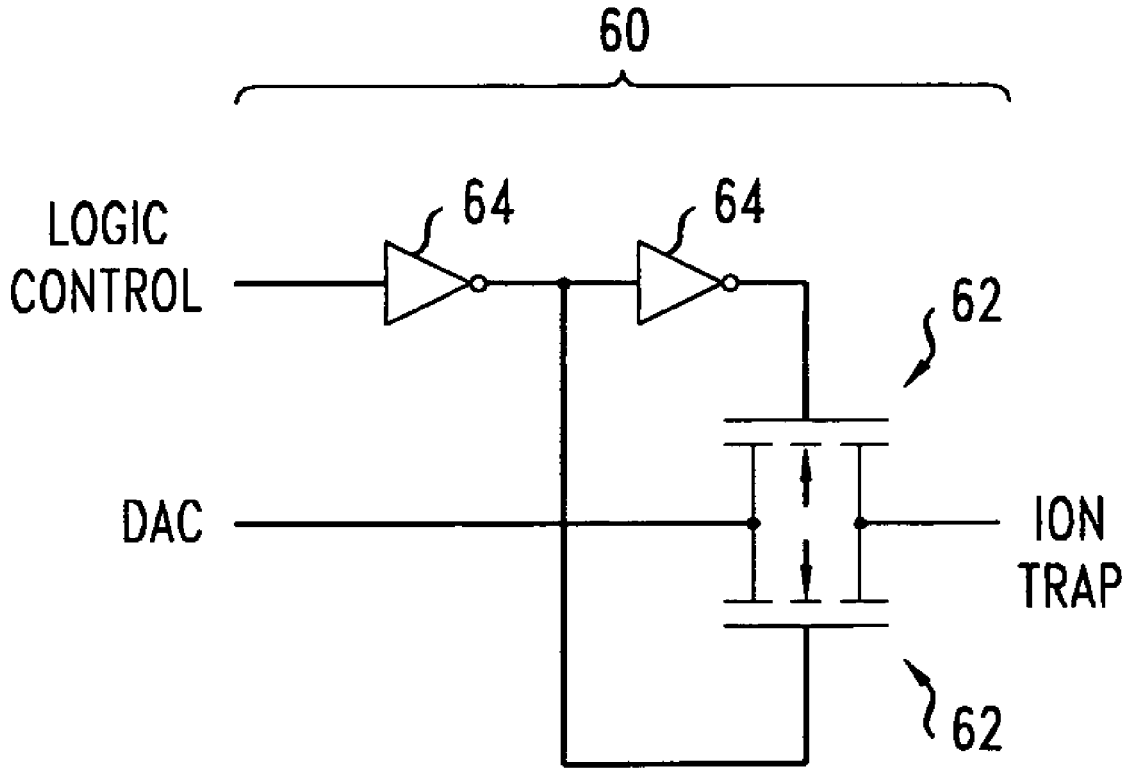
FIG. 8 shows an exemplary transmission gate for controlling one ion trap in the multi-chip module of FIG. 7.

The second semiconductor wafer includes an array of transmission gates 60 that control SVSV voltages applied to the ion traps 20 of the doped first semiconductor wafer 52. Each transmission gate 60 includes back-to-back p-type and n-type FET's 62 that connect an external digital-to-analog converter (DAC) to an associated one of the SVSV electrodes 26, 28 as shown in FIG. 8. Each transmission gate 60 also includes cascaded inverters 64 that control the gates of the p-type and n-type FET's 62 in response to logic control signals. Thus, the transmission gates 60 control application of SVSV control voltages from one or more external DAC's to the ion traps 20 on the first semiconductor wafer 22. The one or more DAC's electrically connect to the transmission gates 60 via one edge of the second semiconductor wafer 54. The second semiconductor wafer 54 may also include an array of integrated resistor or RC and LC filters for each via connection.

The third semiconductor wafer 56 includes digital circuitry for controlling multi-chip module 50. The digital circuitry may perform operations that control the transmission gates 60, receive optical measurements for use in quantum error correction, and perform quantum computing instructions. The digital circuitry may include logic circuitry and storage for a machine executable program of instructions for one of the above-described operations. The digital circuitry may, e.g., be CMOS circuitry. Such circuitry is protected from strong electric fields of the ion traps by the above-described RF screening.

Figure 9:
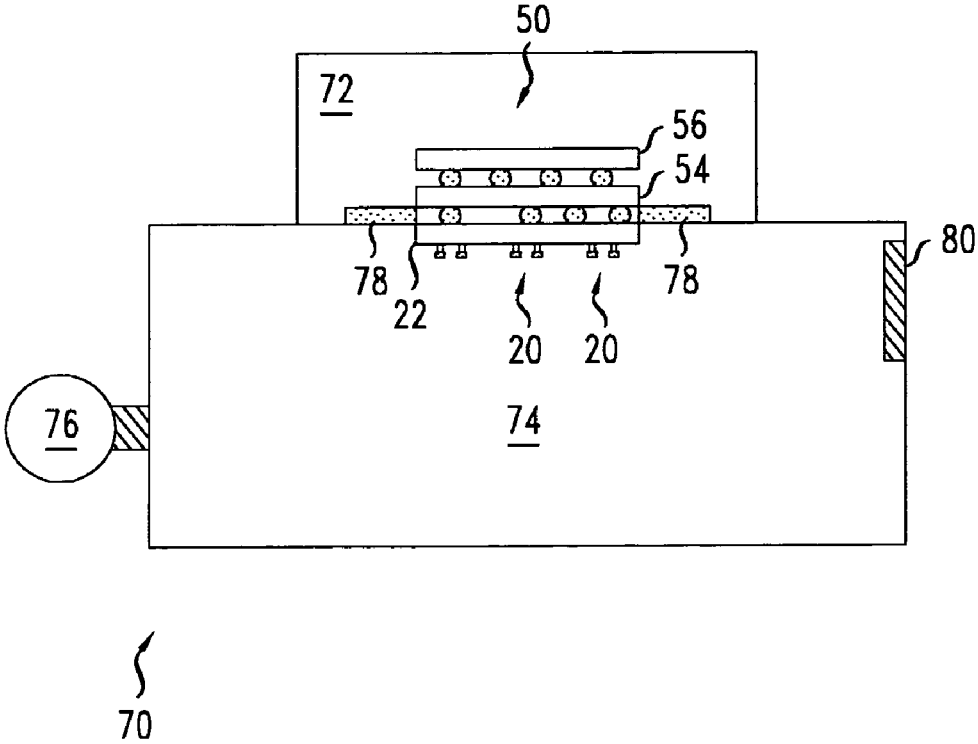
FIG. 9 shows a vacuum setup for operating the ion traps of the multi-chip module of FIG. 7.

FIG. 9 shows a vacuum setup 70 for maintaining an operating environment for the ion traps 20 of the multi-chip module 50 of FIG. 7. The vacuum setup 70 includes first and second chambers 72, 74. The first chamber 72 is either kept at atmospheric pressure or at a low pressure of about $10^{-3}$ or less Torr. The second chamber 74 is maintained at a high vacuum of about $10^{-11}$ Torr by a separate pump 76. The multi-chip module 50 is positioned so that the first semiconductor wafer 22 and a high vacuum seal 78 close a port between the first and second chambers 72, 74. Such a configure seals the second chamber 74 without to individual seal control lines in the high vacuum environment. The ion traps 20 of the first substrate 52 are subjected to the high vacuum of the second chamber 74 and can also be externally illuminated by laser light transmitted through a window 80 in the second vacuum chamber 74.

The operation of the ion traps 20 of the multi-chip module 50 also involves conventional optical cooling and excitation methods. These conventional methods include the Doppler cooling method and Raman sideband cooling. In either case, the optical cooling setup includes one or more lasers and associated collimation optics. In the Doppler cooling method, a laser should typically be tuned to produce light whose frequency is associated with an energy slightly lower than that of the lowest excitation energy in the ion traps 20. For such frequencies, laser light stimulates absorptions and emissions by ions having higher energies. Then, said ions undergo de-excitation, which causes them to fall into lower states of the ion traps 20. Multiple lasers may be used to de-excite vibrational modes that are associated with independent degrees of freedom in the ion traps 20, or one laser beam may be obliquely oriented with respect to the normal modes of the ion trap 20 so that said single laser can de-excite all orthogonal vibrational modes in the ion trap 20.

Various setups for optical cooling use optical elements such as fiber arrays, MEMS mirrors, and/or photonic crystals. For example, such cooling methods may use a grating to enable light of a single laser beam to pass through several ion traps 20 thereby cooling ions in each of the separate ion traps 20. Typically, such optical cooling should be arranged so that ions in different ion traps 20 are illuminated with equal light intensities.

Figure 10:
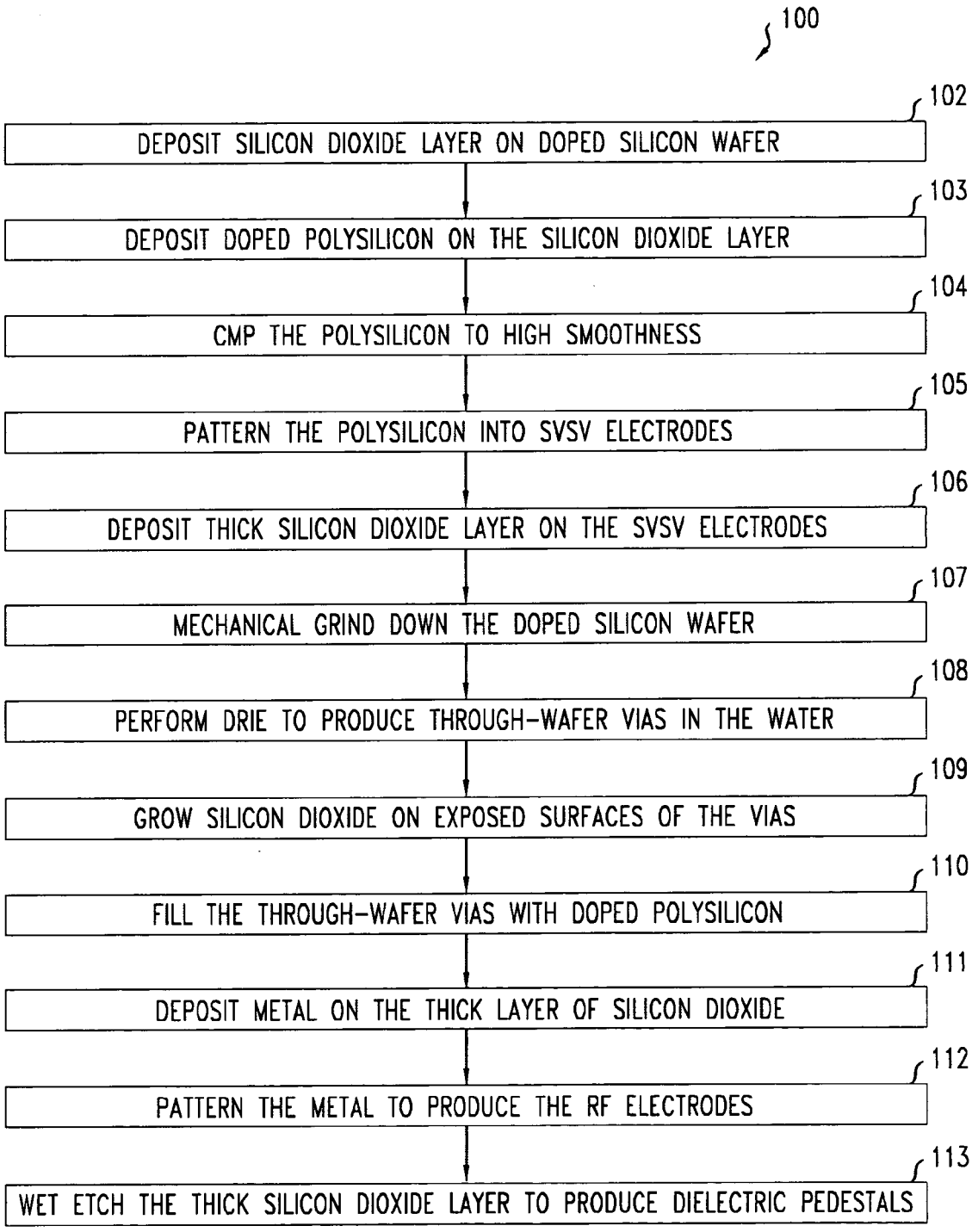
FIG. 10 is a flow chart illustrating one method of fabricating the ion trap of FIG. 2*a;*
Figure 11:
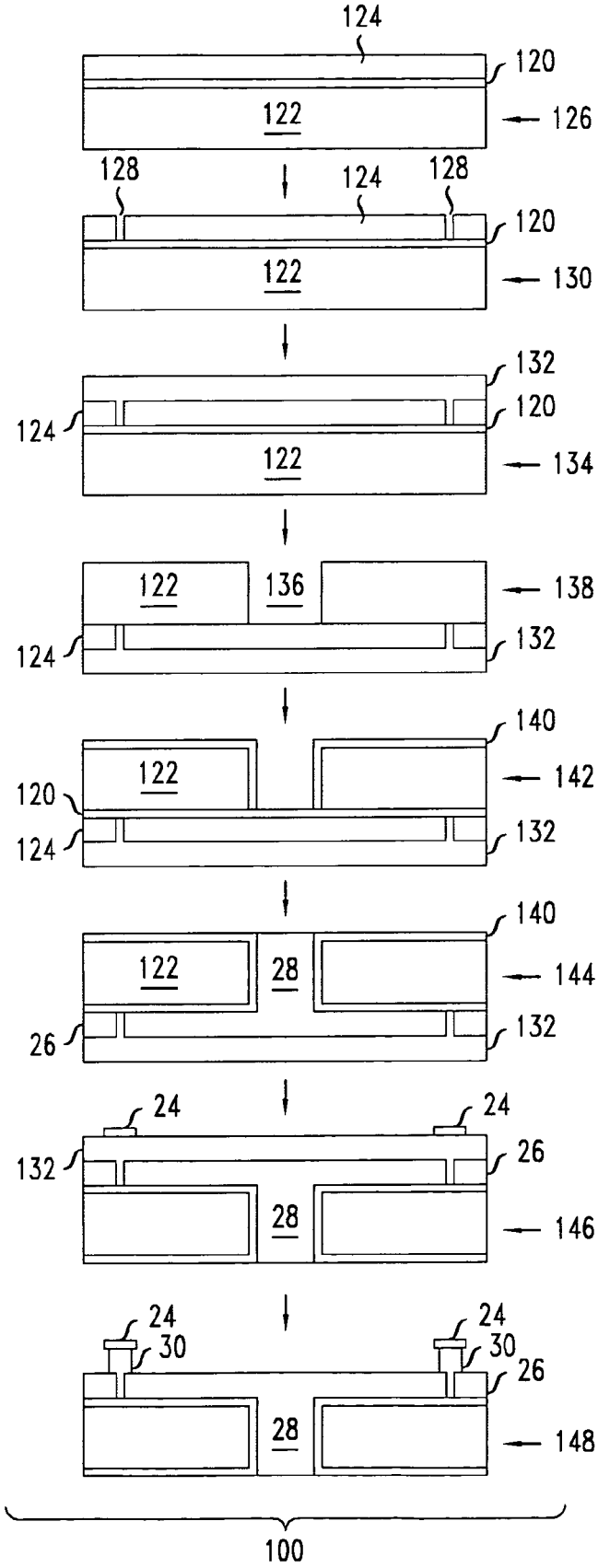
FIG. 11 illustrates intermediate structures fabricated while performing the method of FIG. 10.

FIG. 10 illustrates a method 100 for fabricating one embodiment of the ion trap 20 of FIG. 2*a*. The method 100 involves performing a first sequence of front-side processes, performing a sequence of backside processes, and then, performing a second sequence of front side processes. The processes produce the intermediate structures 126, 130, 134, 138, 142, 144, 146 shown in FIG. 11.

The first sequence of front side processes includes the following steps. First, a plasma enhanced chemical vapor deposition (PECVD) at about 400° C.–500° C. forms a silicon dioxide layer 120 with a thickness of about 300 nanometers (nm) on a top surface of heavily doped silicon wafer 122 (step 102). Next, a low pressure chemical vapor deposition (LPCVD) at 600° C.–700° C. forms a thick layer 124 of about 15 to 30 μm of polysilicon on the silicon dioxide layer 122 as shown in intermediate structure 126 (step 103). During the LPCVD step, the polysilicon is also doped with phosphorous. After the LPCVD, a rapid thermal anneal at about 1040° C. is performed for about 60 seconds to activate the phosphorus thereby causing the doped polysilicon layer 124 to have a low final resistivity of 0.5 to 5 mΩ-cm. Next, a chemical mechanical polish (CMP) of the free surface of the layer 124 of n-doped polysilicon produces a surface where height roughness is of the order of tens of nanometers or less (step 104). The CMP ensures that the final SVSV electrodes 26, 28 will have smooth top surfaces thereby reducing the magnitude of stray electric fields that could otherwise interfere with subsequent ion trapping. The article of K. Miller, D. Fong, D. Dawson, and B. Todd, "Die-scale wafer flatness: 3-dimensional imaging across 20 mm with nanometer-scale resolution", SPIE Proceedings, Vol. 3050 (1997) page 266, which is incorporated by reference herein in its entirety, describes a CMP process that is suitable for making such a smooth surface on a polysilicon layer. Next, a mask-controlled dry etch forms vias 128 through the layer 124 of n-doped polysilicon as shown in intermediate structure 130 (step 105). The vias 128 pattern the layer 124 of n-type polysilicon into the SVSV electrode 26 and the SVSV electrode 28. Next, another LPCVD deposits a thick silicon dioxide layer 132 of about 10–20 μm on the n-doped polysilicon as shown in intermediate structure 134 (step 106). Then, the thick silicon dioxide layer 132 is annealed at 1050° C. for about 4 to 10 hours to release stress and cause densification therein.

The sequence of backside processes includes the following steps. First, a mechanical grinding of the backside of the doped semiconductor wafer 122 reduces the wafer's thickness to about 280 μm (step 107). Then, contact lithography and a deep reactive ion etch (DRIE) produces through-wafer vias 136 as shown in intermediate structure 138 (step 108). A suitable DRIE is described in U.S. Pat. No. 5,501,893, issued Mar. 26, 1996 to F. Laermer et al (Herein, referred to as the '893 patent) and in U.S. patent application Ser. No. 10/656,432, filed Sep. 5, 2003, by C. S. Pai and S. Pau (Herein, referred to as the '432 application). The '893 patent and '432 patent application are incorporated by reference herein in their entirety. Next, a thermal process at about 1,000° C. grows a thin layer 140 of about 0.1 to 0.2 μm of silicon dioxide on the exposed surfaces of the through-wafer vias 136 and on the backside of the doped silicon wafer 122 as shown in intermediate structure 142 (step 109). Next, a series of LPCVD's alternated with CMP's fills the through-wafer vias 136 with n-doped polysilicon as shown in intermediate structure 144 (step 110). The LPCVD process for depositing doped polysilicon has already been described with respect to above-step 103. The CMP's are selected to stop on the silicon dioxide layers 120, 140. The fill step completes fabrication of the SVSV electrodes 26, 28.

The second sequence of front side processes includes the following steps. First, a sputtering process deposits a layer of about 300 nm of metal, e.g., gold, on the top surface of the silicon dioxide layer 132 (step 111). Then, a mask-controlled wet etch patterns the layer of metal to produce the RF electrodes 24 as shown in intermediate structure 146 (step 112). Alternatively, the metal can be patterned using a liftoff process in which, a layer of sacrificial material such as photoresist is deposited, patterned and developed. Then, the metal is deposited on top of the sacrificial material, and the sacrificial material is removed to pattern the metal. After the metal has been patterned, a timed wet etch that is based on an aqueous solution of HF patterns the silicon dioxide layer 132 to produce the insulating dielectric pedestals 30 of final structure 148 (step 113).

Alternately, in method 100, the intermediate structure 126 can be replaced by a structure fabricated by a silicon-on-insulator (SOI) process. In such a structure, the doped semiconductor layer 124 is replaced by a doped crystalline semiconductor layer. Such SOI structures are sold commercially, for example, by Soitec Inc. of Peabody, Mass. 01960, USA.

Figure 12:
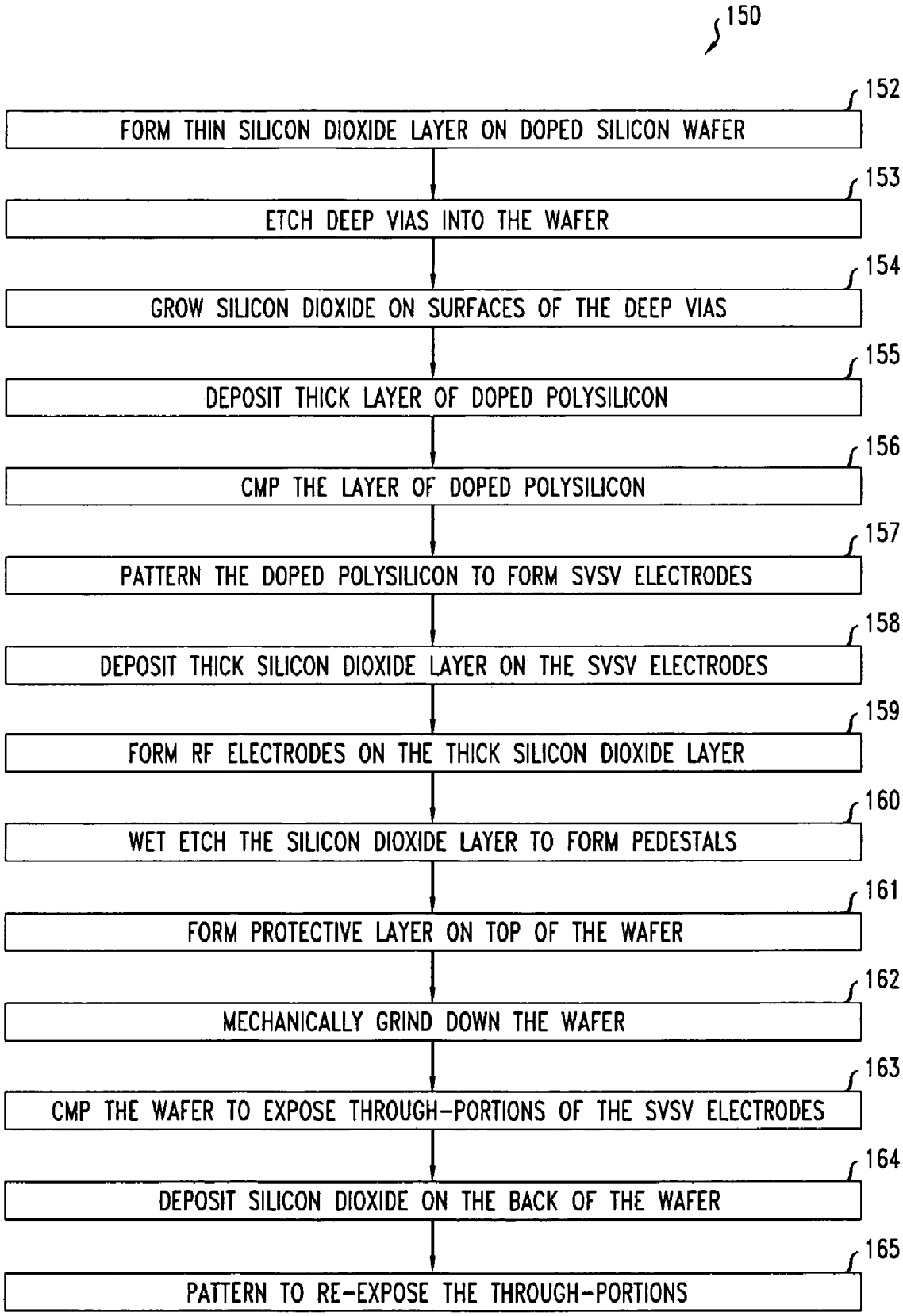
FIG. 12 is a flow chart illustrating an alternate method of fabricating the ion trap of FIG. 2*a*.
Figure 13:
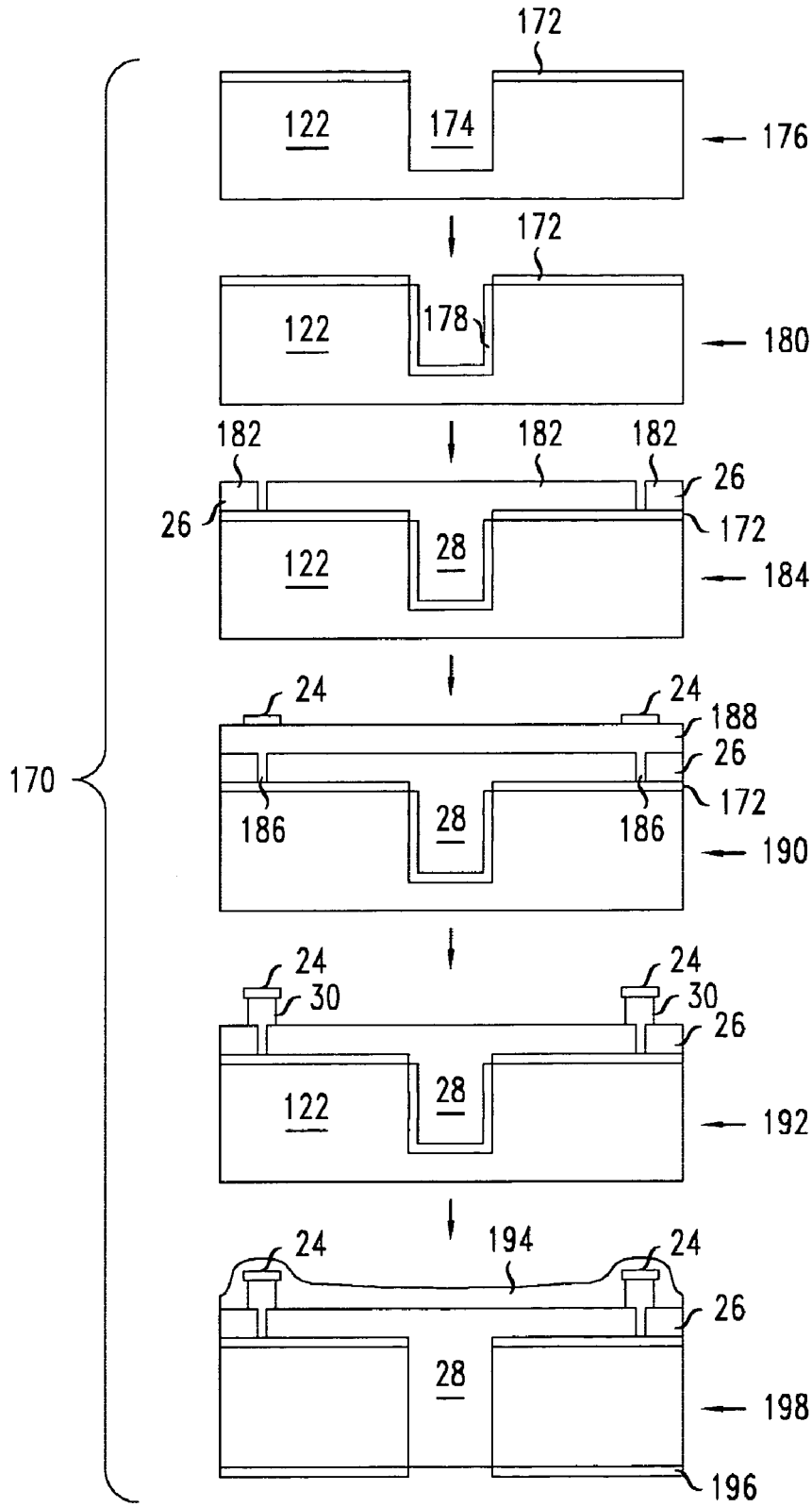
FIG. 13 illustrates intermediate structures fabricated while performing the method of FIG. 12.

FIG. 12 illustrates an alternate method 150 for fabricating the ion trap 20 shown in FIG. 2*a*. The method 150 involves performing a sequence of front-side processes and then, performing a sequence of backside processes on a doped silicon wafer 122. The processes produce intermediate structures 176, 180, 184, 190, 192, 198 as shown in FIG. 13.

The sequence of front side processes includes the following steps. First, a PECVD forms a layer 172 of about 0.5 μm or less of silicon dioxide on the top surface of the doped silicon wafer 122 (step 152). Next, a dry etch forms windows by removing the silicon dioxide from portions of the top surface and then, etches deep vias 174 through the windows as shown in intermediate structure 176 (step 153). The series includes a conventional dry etch of silicon dioxide and a DRIE as already described with respect to above step 108. Both dry etches are controlled by a contact mask. Next, a thermal process grows a layer 178 of about 0.2–0.1 μm or less of silicon dioxide on the exposed surface of the deep vias 176 as shown in intermediate structure 180 (step 154). Next, a LPCVD deposits a thick layer 182 of doped polysilicon on the intermediate structure 180 (step 155). The LPCVD uses the same process described with respect to above step 103. After the LPCVD, the doped polysilicon fills the deep via 174 and also covers the silicon dioxide layer 172. Next, a CMP of the layer 182 of doped polysilicon produces a free surface whose height roughness is of the order of tens of nanometers or less (step 156). A suitable process for the CMP was described with respect to above step 104. Next, a dry etch that stops on silicon dioxide is performed to form through-vias 186 in the layer 182 of doped polysilicon (step 157). The dry etch produces the SVSV electrodes 26, 28 as shown in intermediate structure 184. Next, another LPCVD deposits a silicon dioxide layer 188 with a thickness of about 10–20 μm on the n-doped polysilicon (step 158). Then, the thick silicon dioxide layer 188 is annealed at 1050° C. for about 4 to 10 hours to release stress and cause densification therein. Next, a mask-controlled deposition of gold produces the RF electrodes 24 on the silicon dioxide layer 188 as shown in intermediate structure 190 (step 159). Next, a timed wet-etch with an aqueous solution of HF patterns the silicon dioxide layer 188 to produce insulating dielectric pedestals 30 as shown in intermediate structure 192 (step 160). Finally, a thick layer 194 of resist is deposited over the top surface of intermediate structure 192 and hardened to provide protection during the backside processes (step 161).

The sequence of backside processes includes the following steps. First, a mechanical grind of the backside reduces the thickness of the doped semiconductor wafer 122 to about 280 μm (step 162). Next, a CMP of the backside of the doped semiconductor wafer 122 exposes the polysilicon in the deep vias 174 (step 163). Next, a PECVD forms a thin layer 196 of about 0.5 μm or less of silicon dioxide on the bottom surface of the doped silicon wafer 122 (step 164). Next, a dry etch patterns the layer 196 of silicon dioxide to selectively expose the polysilicon of the through-portions of the SVSV electrodes 26, 28 as shown in intermediate structure 198 (step 165).

Finally, a standard stripping step removes the protective layer of resist from the front side of the intermediate structure 196 thereby producing the ion trap 20 (step 166).

From the disclosure, drawings, and claims, other embodiments of the invention will be apparent to those skilled in the art.

What we claim is:

1. An apparatus comprising:

an electrically conductive substrate having top and bottom surfaces and having vias that cross from the top surface to the bottom surface;

a pair of planar first electrodes supported over said top surface; and second electrodes having planar surfaces located over said top surface, portions of the planar surfaces being laterally adjacent said planar first electrodes; and wherein one of the second electrodes includes a portion that is located in one of the vias and traverses the substrate.

2. The apparatus of claim 1, wherein the substrate is a doped semiconductor.

3. The apparatus of claim 2, further comprising a dielectric layer located between the second electrodes and the substrate.

4. The apparatus of claim 2, wherein the pair of planar first electrodes are separated by more than 50 micrometers.

5. The apparatus of claim 1, wherein the planar electrodes and second electrodes form plates of a first capacitor;

wherein the substrate and the second electrodes form plates of a second capacitor; and wherein a ratio of a capacitance of the second capacitor to a capacitance of the first capacitor is at least as large as 100.

6. The apparatus of claim 5, wherein the ratio of the capacitance of the second capacitor to the capacitance of a first capacitor is at least as large as 500.

7. The apparatus of claim 1, wherein the apparatus is able to trap ions over the planar electrodes in response to the planar electrodes being driven by a voltage having a RF frequency.

8. The apparatus of claim 1, wherein one of the second electrodes is separated from the substrate by 0.5 micrometers or less.

9. The apparatus of claim 1, wherein one of the second electrodes is located between the pair of first electrodes, the one of the second electrodes is separated into segments.

10. The apparatus of claim 9, wherein each segment includes a separate portion that is located in one of the vias and that traverses the substrate.

11. The apparatus of claim 9, wherein one of the second electrodes is surrounded by one or more of the first electrodes.

12. An apparatus, comprising:

an electrically conductive semiconductor substrate having a top surface and a bottom surface and having a plurality of planar ion traps; and each ion trap having first and second electrodes and being configured to trap ions over the top surface of the substrate, each second electrode including a portion that crosses through the substrate.

13. The apparatus of claim 12, wherein the substrate is a doped crystalline semiconductor.

14. The apparatus of claim 13, further comprising a RF driver connected between said substrate and said first electrodes.

15. The apparatus of claim 13, wherein in one of the ion traps, the first electrodes and second electrodes form plates of a first capacitor;

wherein in the one of the ion traps, the substrate and the second electrodes form plates of a second capacitor; and wherein a ratio of a capacitance of the second capacitor to a capacitance of the first capacitor is at least as large as 100.

16. The apparatus of claim 13, wherein the substrate is a metal.

17. The apparatus of claim 12, further comprising:

a second substrate having a top surface disposed adjacent the bottom surface of the first substrate, the second substrate having circuits for controlling said ion traps and being disposed to make physical and electrical connection with said portions.

18. The apparatus of claim 17, wherein the circuits of the second substrate comprise gates and RF filters.

19. The apparatus of claim 12, wherein a first one of said ion traps is configured to trap an ion at a first trap height above the top surface and a second one of said ion traps is configured to trap the ion at a different second trap height above the top surface.

* * * * *